United States Patent [19]

Komatsu et al.

[11] 3,959,092

[45] May 25, 1976

[54] METHOD FOR A SURFACE TREATMENT OF CEMENTED CARBIDE ARTICLE

[75] Inventors: Noboru Komatsu, Toyoake; Tohru Arai; Yoshihiko Sugimoto, both of Nagoya, all of Japan

[73] Assignee: Kabushiki Kaisha Toyota Chuo Kenkyusho, Nagoya, Japan

[22] Filed: Nov. 13, 1973

[21] Appl. No.: 415,393

[30] Foreign Application Priority Data

Nov. 16, 1972 Japan ..... 47-114290

[52] U.S. Cl. ..... 204/39

[51] Int. Cl.[2] ..... C25D 11/00

[58] Field of Search ..... 204/39, 130

[56] References Cited

UNITED STATES PATENTS

| | | | |
|---|---|---|---|
| 556,092 | 3/1896 | Frölich | 204/111 |
| 2,746,915 | 5/1956 | Giesker et al. | 204/56 R |
| 2,950,233 | 8/1960 | Steinberg et al. | 204/39 |
| 2,984,605 | 5/1961 | Cooper et al. | 204/60 |
| 3,485,725 | 12/1969 | Koretzky | 204/38 R |
| 3,671,297 | 6/1972 | Komatsu et al. | 117/118 |

FOREIGN PATENTS OR APPLICATIONS

| | | | |
|---|---|---|---|
| 286,457 | 3/1928 | United Kingdom | 204/39 |

*Primary Examiner*—R. L. Andrews

*Attorney, Agent, or Firm*—Wenderoth, Lind & Ponack

[57] ABSTRACT

A method for forming a very hard layer on the surface of an iron, ferrous alloy or cemented carbide article in a treating molten bath, comprising preparing the treating molten bath composed of boron oxide and chromium, immersing the article in the treating molten bath and applying an electric current to the treating molten bath through said article being used as the cathode, thereby forming a very hard layer composed of chromium carbide and/or chromium boride on the surface of said article. The method of this invention can quickly form a uniform and dense layer on the surface of the article and can be carried out in the open air.

17 Claims, 13 Drawing Figures

(X 400)

(X 400)

(X 400)

(X 400)

(X 400)

(X 400)

(X 400)

(X 400)

(X 400)

(X 400)

(X 400)

(X 400)

METHOD FOR A SURFACE TREATMENT OF CEMENTED CARBIDE ARTICLE

This invention relates to a method for forming a layer composed of chromium carbide and/or chromium boride on the surface of an iron, ferrous alloy or cemented carbide article, and more particularly it relates to the formation of said layer on the surface of the article immersed in a treating molten bath. The iron, ferrous alloy or cemented carbide article with said layer formed thereon has a greatly improved hardness, wear resistance, oxidation resistance and corrosion resistance.

There have been reported several kinds of methods for coating or forming a metallic carbide layer on the surface of metallic articles. We have developed a method for forming a chromium carbide on the surface of a metallic article in a treating molten bath consisting of boron oxide such as boric acid or a borate and a metal powder containing chromium (U.S. Pat. No. 3,671,297). The method can form a uniform carbide layer and is highly productive and inexpensive. The chromium carbide has a very high hardness ranging from Hv 1,800 to Hv 2,000. Therefore, the carbide layer formed represents a high value of hardness and a superior resistance performance against wear and is thus highly suitable for the surface treatment of moulds such as dies and punches, tools such as pinchers and screwdrivers, parts for many kinds of tooling machines, and automobile parts to be subjected to wear.

Further, the chromium carbide represents a greater resistance against oxidation and corrosion than the tungsten carbide forming cemented carbide. Therefore, the formation of the carbide layer on the surface of a cutting tool made of cemented carbide greatly increases the durability of the tool.

Chromium boride has been known to have a nearly similar hardness to that of the chromium carbide. Also said boride has a good wear resistance and corrosion resistance against chemical reagents and molten metal. Therefore, the chromium boride layer formed and the chromium carbide layer containing the boride work as well as the layer composed of only chromium carbide.

The method for forming a chromium carbide layer mentioned above, however, takes a relatively long time for forming a practically acceptable layer.

Therefore, it is the principal object of the present invention to provide an improved method for forming a layer composed by chromium carbide and/or chromium boride on the surface of an iron, ferrous alloy or cemented carbide article in a treating molten bath.

It is another object of this invention to provide a method for quickly forming said layer with denseness and uniformity on the surface of the article.

It is still another object of this invention to provide a method for forming said layer on the surface of the article by applying an electric current to the article.

It is a still further object of this invention to provide a method for forming said layer, which is safe and simple in practice and less expensive.

Other objects of this invention will appear hereinafter.

The novel features that are considered characteristic of the invention are set forth with particularity in the appended claims. The invention itself, as to its method of operation, together with additional objects and advantages therefore, will best be understood from the following description of specific embodiments when read in connection with the accompanying drawings, in which:

Figure 1:
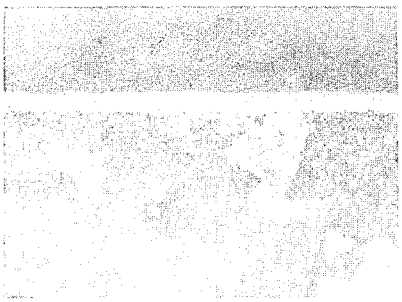
FIGS. 1 to 3 are photomicrographs showing the surface layer on carbon tool steel, which are formed according to Example 1.

Broadly, the present invention is directed to an improvement of the method for forming a chromium carbide layer on an iron, ferrous alloy or cemented carbide article in a treating molten bath, and is characterized by preparing a treating molten bath containing a molten boron oxide, such as boric acid and borate, and chromium, immersing an iron, ferrous alloy or cemented carbide article in the treating molten bath, and applying an electric current to the treating molten bath through the article being used as the cathode for forming a layer composed of chromium carbide and/or chromium boride on the surface of the article.

The electric current acts to deposit the chromium dissolved in the treating molten bath on the surface of the article and accelerates the formation of the chromium carbide layer on the surface of the article. The voltage of the electric current is relatively low. It is not necessary for said voltage to be sufficiently high for electrolysing the molten boron oxide in the treating molten bath. In order to accelerate the formation of the chromium carbide layer on the surface of the article, a relatively high voltage (in other words, a relatively large current density of the cathode) may be employed. In that case, large current density deposits a reduced boron on the surface of the article together with chromium. Therefore, the chromium carbide layer includes a small amount of chromium boride and in some cases, a chromium boride layer is formed on the chromium carbide layer.

The treating molten bath used in the present invention is composed of a molten boron oxide and a substance containing chromium. As said substance, metallic chromium, alloys containing chromium, the oxide and halide of chromium such as $Cr_2O_3$, $(NH_4)_2Cr_2O_7$, $K_2Cr_2O_7$, $K_2CrO_4$, $Na_2Cr_2O_7$ (or a mixture of these oxides), $CrCl_3$, $CrCl_2$, $CrF_3$, $CrBr_3$, $CrI_3$ (or a mixture of these halides) and the like can be used.

As said boron oxide, boric acid ($B_2O_3$), borate such as sodium borate (borax) ($Na_2B_4O_7$), potassium borate ($K_2B_4O_7$) and the like and the mixture thereof can be used. The boric acid and borate have a function to dissolve a metallic oxide and to keep the surface of the article to be treated clean, and also the boric acid and borate are not poisonous and hardly vaporize. Therefore, the method of the present invention can be carried out in the open air. In order to prepare the treating molten bath, the powder of the above mentioned substance is introduced in the molten boron oxide, or the powder of said substance and the powder of said boron oxide are mixed together and then the mixture is heated to its fusing state. By another method, a block of said metals or alloys is immersed in the molten boron oxide bath and anodically dissolved in the molten boron oxide for preparing the treating molten bath.

As the quantity of chromium contained in the treating molten bath, 1% by weight (hereinafter % means % by weight) of chromium dissolved in the treating molten bath is sufficient. In practice, however, the chromium may be dissolved in the treating molten bath in a quantity between 1 and 50%. The critical quantity of the chromium depends on the substance including the chromium. With use of less quantity of chromium than 1%, the speed of formation of a chromium carbide layer would be too slow to be accepted for practical purposes. Too much addition of chromium will increase the viscosity of the treating molten bath to such a high value that the dipping of the article to be treated into the bath may become practically impossible. Even when the immersion is possible with only difficulty, the resulted carbide layer will be too uneven to be accepted.

The remainder of the treating molten bath is molten boron oxide.

When the powders of metallic chromium of the alloy containing chromium such as ferrous chromium are used as the chromium source of the treating molten bath, the treating molten bath should be kept for a time for dissolving the chromium in the boron oxide before immersing the article to be treated into the treating molten bath.

The powders are preferably under 20 mesh for dissolving said powders quickly in the molten bath. The quantity of the powders is 1 to 60%. With less than 1% of the powders added in the treating molten bath, the formation of chromium carbide and/or boride layer on the article treated is unstable and it takes a long time to form a practically thick layer on the surface of the article.

Said method of preparing the treating molten bath is easily operative. However, undissolved particles of powders remain in the bath, and said particles may be mixed into the surface layer formed and adhere to the surface of the layer formed. Besides, said undissolved particles may be piled up on the bottom of the treating vessel and solidified thereon during the treatment of the article.

When the treating molten bath is prepared by dissolving chromium anodically into the molten boron oxide from the metallic block containing chromium, said metallic block is used as the anode, and the vessel containing the molten boron oxide therein or an electrically conductive material dipped in the molten boron oxide is used as the cathode. By applying an electric current to the molten boron oxide, said metallic block is anodically dissolved in the molten boron oxide, and forms a treating molten bath. The application of the current accelerates the dissolution of the chromium into the molten boron oxide. Therefore, a relatively small anodic current density is sufficient. The range of the anodic current density is from 0.1 to 10 $A/cm^2$ and preferably from 0.2 to 5 $A/cm^2$. The quantity of the chromium anodically dissolved in the molten boron oxide is preferably 1% or more than 1% of the treating molten bath. According to this anodic dissolution, the bath is prepared quickly and no undissolved particles remain in the bath, therefore a smooth surface layer on the article is provided.

When the powders of a chromium oxide or a chromium halide are used as the chromium source of the treating molten bath, the bath is quickly prepared and no undissolved particles remain, because the chromium oxides and the chromium halides are dissolved easily in the molten boron oxide.

To form the surface layer, an iron, ferrous alloy or cemented carbide article is immersed in the treating molten bath as the cathode, and a vessel containing the treating molten bath therein may be used as the anode. In cases, metal block containing chromium is used as the anode. Said metal block is anodically dissolved in the treating molten bath during the formation of the layer.

The iron, ferrous alloy or cemented carbide to be treated must contain at least 0.05% of carbon, preferably 0.1% of carbon or higher. The carbon in the article becomes a part of the composition of the carbide during the treatment. Namely it is supposed that the carbon in the article diffuses to the surface thereof and reacts with the metal from the treating molten bath to form the carbide on the surface of the article. A higher content of the carbon in the article is more preferable for forming the carbide layer. The iron, ferrous alloy or cemented carbide article containing less than 0.05% of carbon may not be formed with a uniform and thick carbide layer by the treatment. The article containing at least 0.05% of carbon only in the surface portion thereof can be treated to form a carbide layer on the surface of the article. For example, a pure iron article, which is case-hardened to increase the carbon content in the surface portion thereof, can be used as the article of the present invention.

Here, iron means iron containing carbon and case-hardened iron, ferrous alloy means carbon steel and alloy steel, and cemented carbide means a sintered tungsten carbide containing cobalt. Said cemented carbide may include a small amount of titanium carbide, niobium carbide, tantalum carbide and the like.

In some cases, the carbon contained in the treating molten bath can be used as the source of the carbon for forming the carbide layer on the surface of the article. However, the formation of the carbide layer is not stable and the use of the carbon in the treating molten bath is not practical.

The current density of the cathode may be selected within the range from 0.003 to 15 $A/cm^2$, however, the effective current density of the cathode mainly depends upon the material forming an article to be treated and the substance containing chromium in the treating molten bath.

Use is made of the treating molten bath composed of molten boron oxide and chromium or alloy containing chromium prepared by introducing the powders of said chromium or alloy, or by anodic dissolution of the block made of said chromium or alloy. The article made of iron or ferrous alloy is treated at a current density of the cathode between 0.01 and 6 A/cm$^2$. With the current density of less than 0.01 A/cm$^2$, the formation of a chromium carbide layer is relatively slow. As the current density is increased, the formation of the layer is accelerated, and the composition of the layer formed is gradually changed. With a current density near 0.01 A/cm$^2$, the layer formed is composed of chromium carbide and a small amount of iron dissolved in the carbide. With an increase in the current density, the layer includes a small amount of boron, and then a new layer composed of chromium boride is formed. Finally with a current density of over 6 A/cm$^2$, an iron boride layer is formed. Said iron boride layer is not preferable. The formation of the chromium boride layer is affected not only by the cathodic current density but also by the quantities of the carbon and chromium included in the article and the treating molten bath respectively. Therefore, the formation of the chromium boride layer is not defined by the current density alone. The article made of cemented carbide is treated at a current density of the cathode between 0.01 and 15 A/cm$^2$. When the current density if relatively low, a chromium carbide layer is formed and according to the increase of the current density, the amount of boron in the layer increases. Finally with a current density of over 15 A/cm$^2$, a layer composed of tungsten boride or cobalt boride is formed.

With use of treating molten bath composed of molten boron oxide and a chromium oxide, the current density for the article made of iron, or ferrous alloy is selected within the range from 0.003 to 15 A/cm$^2$. The preferable range of current density is different between the kinds of the oxides. In the case when $K_2Cr_2O_7$ is used as the oxide, the current density may be selected within a range from 0.02 to 15 A/cm$^2$, and more preferably, the current density may be selected in a range from 0.03 to 7 A/cm$^2$. In the case of $(NH_4)_2Cr_2O_7$, the range of the current density is from 0.003 to 2 A/cm$^2$. More preferably, the range is narrowed to from 0.05 to 1.5 A/cm$^2$. In the case of $Cr_2O_3$, the range is from 0.003 to 15 A/cm$^2$. More preferably, the range is from 0.005 to 10 A/cm$^2$. When an article made of cemented carbide is treated, the current density of the cathode may be selected within the range from 0.01 to 15 A/cm$^2$.

With use of a treating molten bath composed of molten boron oxide and a chromium halide, the current density for treating the article made of iron or ferrous alloy may be selected within the range from 0.01 to 2 A/cm$^2$, and the article made of cemented carbide is treated within the range from 0.01 to 15 A/cm$^2$.

Before the treatment, it is important to purify the surface of the article for forming a good carbide layer by washing the rust and oil from the surface of the article with acidic aqueous solution or another liquid.

The treating temperature may be selected within the range from the melting point of boric acid or borate to the melting point of the article to be treated. Preferably, the treating temperature may be selected within the range from 800° to 1,100°C. With lowering of the treating temperature, the viscosity of the treating molten bath increases gradually and the thickness of the carbide layer formed decreases. However, at a relatively high treating temperature, the treating molten bath deteriorates rapidly. Also the quality of the material forming the article is deteriorated by increasing the crystal grain sizes of said material. In order to lower both the treating temperature and the viscosity of the treating molten bath, a salt such as sodium chloride (NaCl), potassium chloride (KCl) and sodium fluoride (NaF), an oxide such as phosphoric oxide ($P_2O_5$), a hydroxide such as sodium hydroxide (NaOH) and potassium hydroxide (KOH), a sulfate, carbonate and nitrate can be added into the treating molten bath. With use of the treating molten bath containing these additives, the layer can be formed on the surface of an article at such a relatively low temperature as 740°C or lower than 740°C.

The treating time depends upon the thickness of the layer to be formed, treating temperature and the current density of the anode. Treating time of shorter than 2 minutes will, however, provide no practically accepted formation of said layer. With the increase of the treating time, the thickness of the layer will be increased correspondingly. In practice, an acceptable thickness of the layer can be realized within 5 hours or shorter time. The preferable range of the treating time will be from 2 minutes to 5 hours.

The vessel containing the treating molten bath of the present invention can be made of graphite or heat resistant steel.

It is not necessary to carry out the method of the present invention in an atmosphere of non-oxidation gas, but the method can be carried out in either air or an inert gas atmosphere.

EXAMPLE 1

Figure 2:
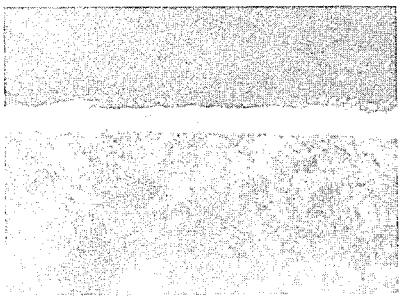

700 grams of borax was introduced into a graphite crucible having a 65mm inner diameter and heated up to 950°C in an electric furnace under air. Then, into the crucible was introduced 175 grams of ferrochromium (containing 65% of chromium) powder of less than 100 mesh, mixed together and kept at 950°C. Thus, the treating molten bath was prepared. By using the treating molten bath, each of Specimens 1–1 to 1–11 having a 7mm diameter and made of carbon tool steel (JIS SK4, containing 1.0% of carbon) was immersed into the treating molten bath and applied respectively with an electric current for a time using said specimen as the cathode. The current density of the cathode applied was within the range from 0 to 10 A/cm$^2$. Specimen 1–1 was treated for 3 hours without applying a current. Specimens 1–2 to 1–7 were treated for 3 hours with a current density of 0.01 A/cm$^2$, 0.03 A/cm$^2$, 0.08 A/cm$^2$, 0.3 A/cm$^3$, 0.7 A/cm$^2$ and 1 A/cm$^2$ respectively. Specimens 1–8 and 1–9 were treated for 10 minutes with a current density of 3 A/cm$^2$ and 6 A/cm$^2$ respectively. Specimens 1–10 and 1–11 were treated for 5 minutes with a current density of 8.0 A/cm$^2$ and 10 A/cm$^2$ respectively. After taking each of the Specimens out of the treating molten bath, the treated Specimens were cooled in the air, washed with hot water and examined. All Specimens were cut vertically and the cross sections were polished and microscopically observed. Also, Specimens were examined by X-ray micro analyzer and by X-ray diffraction method. Specimens 1–1 to 1–7 were formed with a layer of 6 microns($\mu$), 8$\mu$, 8$\mu$, 9$\mu$, 12$\mu$, 13$\mu$ and 14$\mu$ respectively on the surface of each of Specimens 1–1 to 1–7. All the layers formed on Specimens 1–1 to 1–7 were dense and uniform as the layers shown in FIGS. 1 and 2. The photomicrographs shown in FIGS. 1 and 2 were taken from Specimens 1–4 and 1–5. From the results by X-ray micro analyzer and by X-ray diffraction method, the layers formed were found to be chromium carbide containing iron, $(Cr,Fe)_7C_3$ and/or $(Cr,Fe)_{23}C_6$. The layers formed on Specimens 1–2 to 1–7 were identified to contain a small amount of boron. The boron contained in the layer of Specimen 1–2 was very little.

Figure 3:
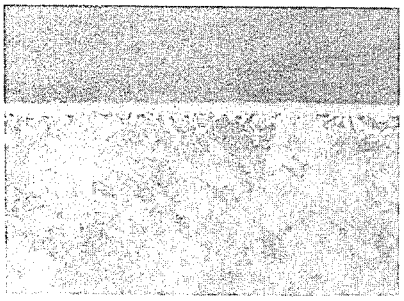

Specimens 1–8 and 1–9 were formed respectively with a layer consisting of an upper layer and a lower layer. As an example, the layer formed on Specimen 1–9 was shown in FIG. 3. By X-ray micro analyzer and by X-ray diffraction method, the upper layer was found to be chromium boride containing iron, $(Cr,Fe)_2B$, and the lower layer was found to be iron boride ($Fe_2B$).

Specimens 1–10 and 1–11 were formed with a dendritic layer on each the surfaces of the Specimens. The layer was found to be iron boride (FeB and/or $Fe_2B$) containing little chromium.

From this example, it was recognized that the application of an electric current as small as a current density of 0.01 A/cm² to the specimen treated increased the thickness of the layer formed on the specimen compared with that of the layer formed without applying a current and that, according to the increase of the electric current applied for forming a layer, the boron contained in the formed layer increased and the layer formed with a current density over 6 A/cm² was iron boride.

EXAMPLE 2

700 grams of borax was introduced into a graphite crucible and heated up to 900°C for melting the borax in an electric furnace and then a ferrochromium plate, 7 × 40 × 90mm, (containing 65% of chromium) was dipped in the molten borax. With use of the plate and the crucible as an anode and cathode respectively, said plate was anodically dissolved in the molten borax by applying a direct current for 8 hours at a current density of 1 A/cm². Thus, a treating molten bath containing 4.4% of chromium was prepared.

Next, Specimens 2–1 to 2–5 having a diameter of 7mm and made of carbon tool steel (JIS SK4) were respectively immersed in the treating molten bath and were treated at 900°C under respective conditions. Specimen 2–1 was treated for 2 hours and with a current density of 0.01 A/cm², Specimens 2–2 to 2–5 were treated respectively for 2 hours with 0.05 A/cm², for two hours with 0.1 A/cm², for 10 minutes with 1 A/cm² and for 5 minutes with 6 A/cm².

Figure 4:
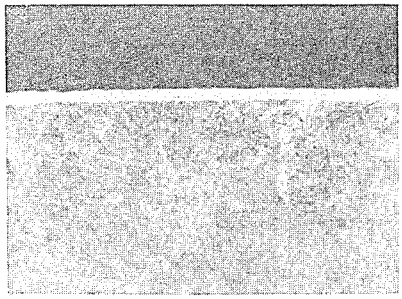
FIG. 4 is a photomicrograph showing the surface layer formed on carbon tool steel according to Example 2.

All Specimens 2–1 to 2–5 were examined by a microscope, by X-ray micro analyzer and by X-ray diffraction method. Specimens 2–1 to 2–5 were formed with a layer or layers having a respective thickness of 6μ, 7μ, 8μ, 5μ and 65μ. Specimens 2–1 to 2–4 were each formed with one layer and Specimen 2–5 was formed with two layers. FIG. 4 shows a microphotograph of the layer formed on Specimen 2–1. By the results of X-ray micro analyzer and X-ray diffraction method, the layers formed on Specimens 2–1 to 2–4 were identified to be chromium carbide containing iron and boron, $(Cr,Fe)_{23}(C,B)_6$ and/or $(Cr,Fe)_7(C,B)_3$. The layers formed on Specimen 2–5 were recognized to consist of an upper layer of chromium boride containing iron $(Cr,Fe)_2B$ and a lower layer of iron boride ($Fe_2B$).

EXAMPLE 3

In the same manner as described in Example 2, the molten borax (700 grams) was prepared and then a ferrochromium plate 7 × 30 × 50mm (containing 65% of chromium) and a specimen having a diameter of 7mm and made of carbon tool steel (JIS SK4) were dipped in the molten borax maintaining a distance therebetween. With use of said plate as an anode and the specimen as the cathode, an electric current was applied to the molten borax for 4 hours at a cathodic current density of 0.01 A/cm². By the treatment, the specimen was formed with a layer of about 5 microns. The layer was identified to be chromium carbide containing iron and boron, $(Cr,Fe)_{23}(C,B)_6$ and/or $(Cr,Fe)_7(C,B)_2$.

From this example, it was recognized that the formation of the carbide layer on an article and the dissolution of chromium in the treating bath could be carried out at the same time.

EXAMPLE 4

500 grams of borax was introduced into a graphite crucible of an inner diameter of 65mm and heated up to 900°C for melting the borax in an electric furnace under the air. Then, 125 grams of chromium oxide was gradually introduced and mixed up to prepare a treating molten bath containing 20% of chromium oxide dissolved therein.

Next, Specimens 4–1 to 4–13 having a diameter of 7mm and made of carbon tool steel (JIS SK4) were respectively immersed into the treating molten bath and were treated at 900°C under respective conditions in the same manner as described in Example 1. Specimen 4–1 was treated for 2 hours without applying an electric current, Specimens 4–2 to 4–7 were treated for 2 hours with 0.002 A/cm², 0.005 A/cm², 0.01 A/cm², 0.1 A/cm² and 0.5 A/cm² respectively, Specimens 4–8 and 4–9 were treated for 10 minutes with 1 A/cm² and 3 A/cm² respectively, Specimen 4–10 was treated for 5 minutes with 5 A/cm², and Specimens 4–11 to 4–13 were treated for 2 minutes with 10 A/cm² , 15 A/cm² and 20 A/cm² respectively.

Figure 5:
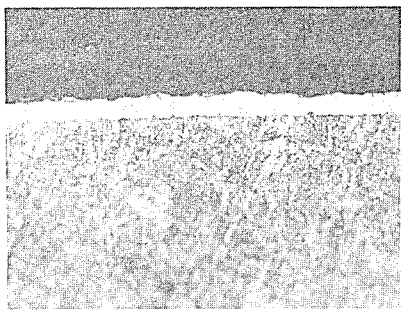
FIG. 5 is a photomicrograph showing the surface layer formed on carbon tool steel according to Example 4.

All Specimens 4–1 to 4–13 were examined by a microscope, by X-ray micro analyzer and by X-ray diffraction method. No layers were formed on Specimens 4–1 and 4–2. Specimens 4–3 to 4–13 were formed with a layer or layers having a respective thickness of 7 microns, 9μ, 10μ, 12μ, 13μ, 4μ, 5μ, 4μ, 4μ, 8μ and 56μ. The layers formed on Specimens 4–3 to 4–10 were identified to be chromium carbide, $Cr_{23}C_6$ and/or $Cr_7C_3$. Also, the carbide layers formed on Specimens 4–6 to 4–10 were found to contain boron. As an example of the layers, a microphotograph of the layer formed on Specimen 4–6 is shown in FIG. 5.

Specimens 4–11 and 4–12 were each formed with two layers, namely an upper layer and a lower layer. The upper layer was identified to be chromium boride containing iron, $(Cr,Fe)_2B$ and the lower layer was iron boride ($Fe_2B$). The layer formed on Specimen 4–13 was a layer of iron boride and neither a chromium carbide layer nor chromium boride layer were identified on Specimen 4–13.

EXAMPLE 5

In the same manner as described in Example 4, 500 grams of molten borax was prepared and then 135 grams of $(NH_4)_2Cr_2O_7$ powder was gradually introduced into the molten borax and mixed up to prepare a treating molten bath containing 21% of said powder dissolved therein.

Next, Specimens 5–1 to 5–9 having a diameter of 7mm and made of carbon tool steel (JIS SK4) were respectively immersed into the treating molten bath and were treated at 900°C under respective conditions in the same manner as described in Example 1. Specimens 5–1 to 5–6 were treated for two hours with a respective current density of 0.002 A/cm², 0.005 A/cm², 0.01 A/cm², 0.05 A/cm², 0.1 A/cm² and 0.5 A/cm², Specimens 5–7 and 5–8 were treated for 10 minutes with a respective current density of 1 A/cm² and 3 A/cm², and Specimen 5–9 was treated for 5 minutes with 5 A/cm².

Figure 6:
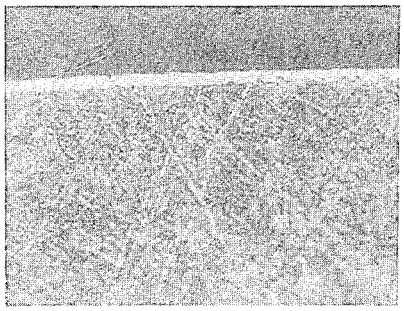
FIG. 6 is a photomicrograph showing the surface layer formed on carbon tool steel according to Example 5.

All Specimens 5–1 to 5–9 were examined by a microscope, by X-ray micro analyzer and by X-ray diffraction method. No layers were formed on Specimen 5–1. Specimens 5–2 to 5–7 were formed with a chromium carbide layer having a respective thickness of 5$\mu$, 6$\mu$, 17$\mu$, 15$\mu$, 18$\mu$ and 10$\mu$. As an example of the layers, a microphotograph of the layer formed on Specimen 5–7 was shown in FIG. 6. Specimens 5–8 and 5–9 were formed with a thick iron boride layer having a thin chromium carbide layer on the surface of said iron boride layer.

EXAMPLE 6

In the same manner as described in Example 4, 500 grams of molten borax was prepared and then 157 grams of $K_2Cr_2O_7$ powder was gradually introduced into the molten borax and mixed up to prepare a treating molten bath containing 24% of said powder dissolved therein. Specimens 6–1 to 6–11 having a diameter of 7mm and made of carbon tool steel (JIS SK4) were respectively immersed into the treating molten bath and were treated at 900°C under respective conditions in the same manner as described in Example 1. Specimens 6–1 to 6–5 were treated for 30 minutes with a respective current density of 0.01 A/cm², 0.05 A/cm², 0.1 A/cm², 0.3 A/cm² and 0.5 A/cm², Specimens 6–6 and 6–7 were treated for 10 minutes with a respective current density of 1 A/cm² and 3 A/cm², and Specimens 6–8 to 6–11 were treated for 5 minutes with a respective current density of 5 A/cm², 7 A/cm², 10 A/cm² and 13 A/cm².

Figure 7:
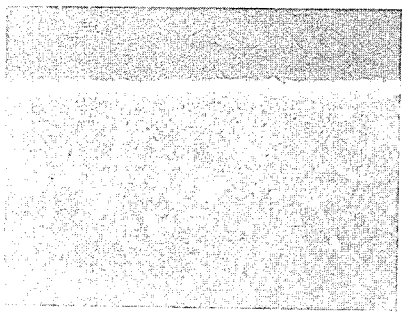
FIG. 7 is a photomicrograph showing the surface layer on carbon tool steel, which is formed according to Example 6.

No layers were formed on Specimens 6–1 to 6–3. Specimens 6–4 to 6–10 were formed with a chromium carbide layer having a thickness within a range from 7 to 12 microns. As an example of the layers, a photomicrograph taken from Specimen 6–8 is shown in FIG. 7. Specimen 6–11 was formed with a thick iron boride layer of about 85 microns. Said layer was identified to have a thin chromium boride layer at its upper surface.

EXAMPLE 7

In the same manner as described in Example 4, 500 grams of molten borax was prepared and then 82 grams of chromium chloride ($CrCl_3$) powder was introduced into the molten borax and mixed up to prepare a treating molten bath containing said powder dissolved therein. Specimens having a diameter of 7mm and a length of 40mm and made of carbon tool steel were respectively immersed into the treating molten bath and were treated at 1,000°C for a time within a range from 5 to 120 minutes and at a current density within a range from 0.01 to 5 A/cm².

Figure 8:
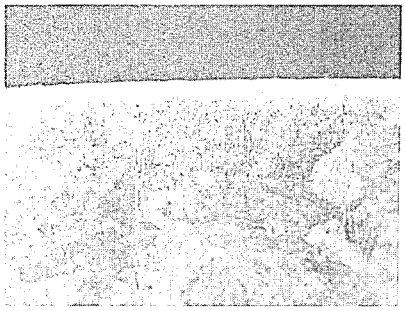
FIG. 8 is a photomicrograph showing the surface layer formed on carbon tool steel according to Example 7.

All the treated specimens were examined by a microscope, by X-ray micro analyzer and by X-ray diffraction method. Specimens treated for 120 minutes with a respective current density of 0.01 and 0.05 A/cm² were formed respectively with a chromium carbide $(Cr,Fe)_7C_3$ layer having a respective thickness of 10 microns and 11 microns. Specimens treated respectively for 120 minutes with 0.1 A/cm², for 120 minutes with 0.5 A/cm² and for 10 minutes with 1 A/cm² were formed with a chromium carbide layer containing boron, $(Cr,Fe)_7(C,B)_3$, having a respective thickness of 11$\mu$, 9$\mu$ and 11$\mu$. The microphotograph shown in FIG. 8 shows a chromium carbide layer formed on the specimen treated for 120 minutes with 0.1 A/cm². Specimens treated for 10 minutes with 2 A/cm² were formed with a layer of 15 microns and have chromium boride, $(Cr,Fe)_2B$, on the surface of the layer. Specimens treated respectively for 10 minutes with 3 A/cm² and for 5 minutes with 5 A/cm² were formed with an iron boride ($Fe_2B$) layer of a respective thickness of 16$\mu$ and 21$\mu$.

EXAMPLE 8

In the same manner as described in Example 4, 500 grams of molten borax was prepared and then 120 grams of chromium fluoride ($CrF_3$) powder was introduced into the molten borax and mixed up to prepare a treating molten bath containing said powder dissolved therein. Specimens having a diameter of 7mm and a length of 40mm and made of carbon tool steel were respectively immersed into the treating molten bath and were treated at 1,000°C for a time within a range from 3 to 120 minutes with a current density within a range from 0.01 to 5 A/cm².

Figure 9:
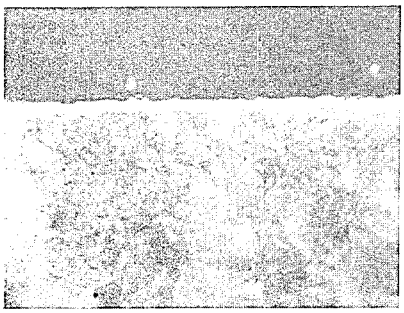
FIG. 9 is a photomicrograph showing the surface layer formed on carbon tool steel according to Example 8.

All the treated specimens were examined by a microscope, by X-ray micro analyzer and by X-ray diffraction method. Specimens treated for 120 minutes with a respective current density of 0.01 and 0.05 A/cm² were formed respectively with a chromium carbide layer composed of $(Cr,Fe)_7C_3$ and having a respective thickness of 9$\mu$ and 10$\mu$. Specimens treated respectively for 120 minutes with 0.1 A/cm², for 120 minutes with 0.1 A/cm², for 120 minutes with 0.5 A/cm², and for 10 minutes with 1 A/cm² were formed with a chromium carbide layer containing boron, $(Cr,Fe)_7(C,B)_3$, and having a respective thickness of 11$\mu$, 10$\mu$ and 6$\mu$. The microphotograph shown in FIG. 9 shows a chromium carbide layer formed on the specimen treated for 10 minutes with 1 A/cm². Specimens treated respectively for 10 minutes with 3 A/cm² and for 3 minutes with 5 A/cm² were formed with an iron boride layer composed of $Fe_2B$ and having a respective thickness of 50$\mu$ and 40$\mu$.

EXAMPLE 9

In this same manner as described in Example 1, a treating molten bath composed of 500 grams of borax and 56 grams of metallic chromium powder dissolved therein was prepared and kept at 1,000°C. Then, Specimens 9–1 to 9–11, 1.0 × 5.5 × 40mm, made of cemented carbide composed of 91% of tungsten carbide and 9% of cobalt were immersed respectively and treated under respective conditions shown in Table 1 in the same manner as described in Example 1.

Table 1

| Sample No. | 9-1 | 9-2 | 9-3 | 9-4 | 9-5 | 9-6 | 9-7 | 9-8 | 9-9 | 9-10 | 9-11 |
|---|---|---|---|---|---|---|---|---|---|---|---|
| Current density ($A/cm^2$) | 0.03 | 0.05 | 0.1 | 0.3 | 0.5 | 1.0 | 3.0 | 5.0 | 10 | 15 | 20 |
| Treating time | 13 hr. | 13 hr. | 9 hr. | 5 hr. | 4 hr. | 1 hr. | 10 min. | 10 min. | 10 min. | 10 min. | 1 min. |
| Thickness of the formed layer($\mu$) | 9 | 12 | 16 | 15 | 20 | 8 | 5 | 12 | 20 | 30 | 8 |

Figure 10:
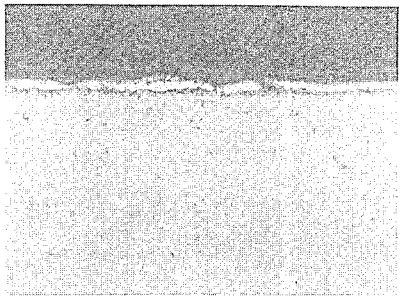
FIG. 10 is a photomicrograph showing the surface layer formed on cemented carbide according to Example 9.
Figure 11:
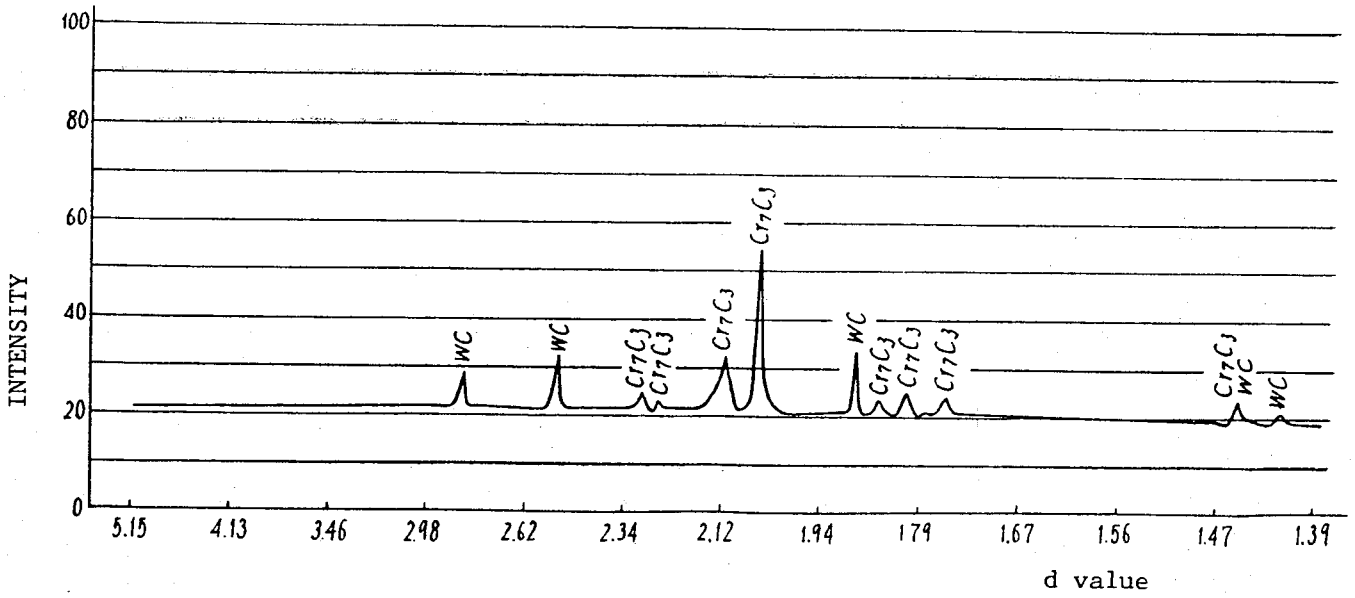
FIG. 11 is an X-ray diffraction chart of the surface layer formed on cemented carbide according to Example 9.

After taking each of Specimens out of the treating molten bath, the treated specimens were cooled in the air, washed with hot water and examined by a microscope, by X-ray micro analyzer and by X-ray diffraction method. By the microscopic observation, all Specimens 9–1 to 9–11 were formed with a layer or layers. The thickness of each of the layers is shown in Table 1. From the results shown in Table 1, the thickness of a formed layer has a tendency to increase according to the increase of an electric current density applied during the treatment. The microphotograph shown in FIG. 10 shows a layer formed on Specimen 9–4. By X-ray diffraction method, strong diffraction lines of chromium carbide ($Cr_7C_3$) were detected from the layers formed on Specimens 9–1 to 9–10. From the layer formed on Specimen 9–11 the chromium carbide diffraction lines, were not detected, however, strong diffraction lines of tungsten boride ($W_2B_5$) were detected. The diffraction chart shown in FIG. 11 was taken from the layer formed on Specimen 9–1. From the results of X-ray micro analyzer, the layers formed on Specimens 9–9 and 9–11 were found to contain boron. Although it was difficult to measure the content of boron by X-ray micro analyzer, the content of the boron contained within the layer which was formed with a large current density on Specimen 9–11 was estimated to be relatively large.

In order to test the oxidation resistance and corrosion resistance of the specimens treated according to this Exammple, many specimens, treated under the same conditions as those of Specimen 9–3 and 9–4, and non-treated specimens, wre subjected to either an oxidation test or a corrosion test. The oxidation test was carried out by heating a specimen in the open air at 800°C for 1 hour and then measuring the weight gain of the speicmen due to the oxidation of the specimen. The corrosion test was carried out by dipping a specimen into an aqueous solution containing 10% of nitric acid ($HNO_3$) for 50 hours at 20°C and then measuring the weight loss of the specimen due to the dissolution of the specimen. The oxidation gains of the specimens treated under the same conditions as those of Specimens 9–3 and 9–4 were 5.12 and 4.59 $mg/cm^2$ respectively. In comparison, the oxidation gain of the non-treated specimen was 61.87 $mg/cm^2$. The dissolved weight loss of the specimens treated under the same conditions as those of Specimens 9–3 and 9–4 were 4.61 and 2.54 $mg/cm^2$ respectively. In comparison, the dissolved weight loss of the non-treated specimen was 23.07 $mg/cm^2$.

It is apparent from the results that the cemented carbide articles with the chromium carbide layer formed according to this example have great oxidation and corrosion resistance.

EXAMPLE 10

In the same manner as described in Example 4, a treating molten bath composed of 500 grams of borax and 82 grams of chromium oxide ($Cr_2O_3$) powder dissolved therein was prepared and kept at 1,000°C. Then, Specimens 10–1 to 10–9, 1.0 × 5.5 × 40mm, made of cemented carbide composed of 91% of tungsten carbide and 9% of cobalt were immersed respectively and treated under respective conditions shown in Table 2.

Table 2

| Sample No. | 10-1 | 10-2 | 10-3 | 10-4 | 10-5 | 10-6 | 10-7 | 10-8 | 10-9 |
|---|---|---|---|---|---|---|---|---|---|
| Current density $A/cm^2$) | 0.01 | 0.05 | 0.1 | 0.5 | 1.0 | 5.0 | 10 | 20 | 30 |
| Treating time | 16 hr. | 15 hr. | 12 hr. | 15 hr. | 5 hr. | 1 hr. | 10 min. | 1 min. | 1 min. |
| Thickness of the formed layer ($\mu$) | 8 | 10 | 10 | 13 | 10 | 20 | 10 | 6 | 15 |

After taking each of Specimens out of the treating molten bath, the treated specimens were cooled in the air, washed with hot water and examined. By the microscopic observation all Specimens 10–1 to 10–9 were formed with a layer or layers. The thickness of each of the layers are shown in Table 2. By X-ray diffraction method, diffraction lines of chromium carbide ($Cr_7C_3$) were detected from all of the layers formed on Specimens 10–1 to 10–9. From the layers formed on Specimens 10–4 to 10–9 were detected chromium boride (CrB) in addition to the chromium carbide ($Cr_7C_3$). And from the layers formed on Specimens 10–6 to 10–9 were detected cobalt boride ($Co_2B$) in addition to the chromium carbide and chromium boride.

Several treated specimens were subjected to either the oxidation test or the corrosion test which were explained in Example 9. The oxidation weight gains of the specimens treated under the saame conditions of those of Samples 10–2 and 10–4 were respectively 16.41 $mg/cm^2$ and 9.64 $mg/cm^2$. The dissolution weight loss of the specimen treated under the same condition as that of Specimen 10–2 was 7.04 mg/cm².

From the test results, it is apparent that the cemented carbide article with the chromium carbide layer formed according to this Example has great oxidation and corrosion resistance.

EXAMPLE 11

In the same manner as described in Example 4, a treating molten bath composed of 500 grams of borax and 157 grams of $K_2Cr_2O_7$ powder dissolved therein was prepared and kept at 1,000°C. Then, Specimens 11–1 to 11–4 having the same shape and made of the same cemented carbide as those of the Specimens used in Example 9 were immersed respectively and treated under the respective conditions shown in Table 3.

Table 3

| Sample No. | 11-1 | 11-2 | 11-3 | 11-4 |
|---|---|---|---|---|
| Current density (A/cm²) | 0.03 | 0.3 | 3.0 | 10 |
| Treating time | 15 hr. | 16 hr. | 30 min. | 10 min. |
| Thickness of the formed layer (μ) | 10 | 13 | 6 | 5 |

Figure 12:
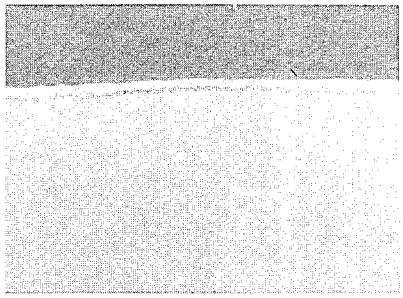
FIG. 12 is a photomicrograph showing the surface layer formed on cemented carbide according to Example 11.
Figure 13:
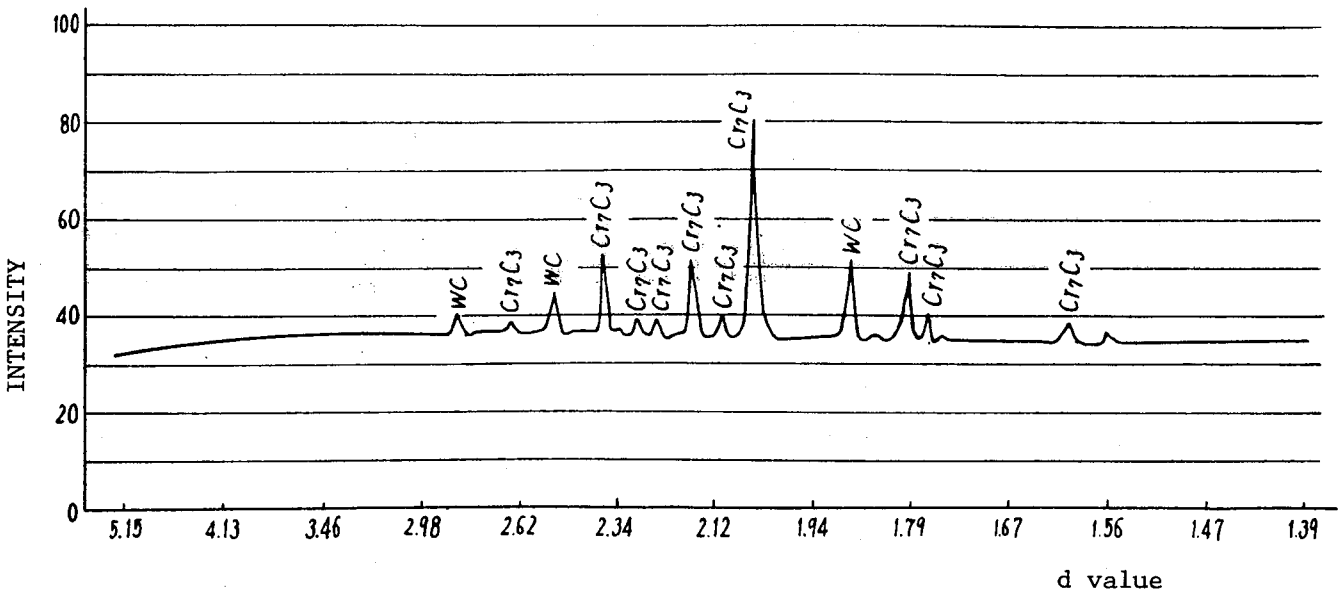
FIG. 13 is an X-ray diffraction chart of the surface layer formed on cemented carbide according to Example 11.

By the treatment, Specimens 11–1 to 11–4 were formed with a layer having a respective thickness shown in Table 3. From the layers formed on Specimens 11–1 to 11–4 were detected chromiun carbide ($Cr_7C_3$) by X-ray diffraction method. As an example of the layers, the layer formed on Specimen 11–3 is shown in FIG. 12. Also the X-ray diffraction chart taken from the layer formed on Specimen 11–3 is shown in FIG. 13. The content of the chromium contained the layer formed on Specimen 11–3 was measured to be about 75% by X-ray micro analyzer.

The layers formed on Specimen 11–4 were identified to be composed of an upper layer of chromium boride (CrB), a middle layer of chromium carbide ($Cr_7C_3$) and a lower layer of cobalt boride ($Co_2B$). The cobalt boride layer occupied the large part of the thickness of the layers.

EXAMPLE 12

In the same manner as described in Example 8, a treating molten bath composed of 500 grams of borax and 117 grams of chromium fluoride ($CrF_3$) powder dissolved therein was prepared and kept at 1,000°C. Then Specimens 12–1 and 12–2 having the same shape and made of the same cemented carbide as those of the Specimens used in Example 9 were immersed respectively and treated for 14 hours with 0.5 A/cm² and for 3 minutes with 10 A/cm² respectively. By the treatments, Specimens 12–1 and 12–2 were formed with a layer having a respective thickness of about 12μ and about 5μ. From the layer formed on Specimen 12–1, strong diffraction lines of chromium carbide ($Cr_7C_3$) were detected. Also the layer formed on Specimen 12–2 was identified to be a chromium carbide layer containing boron.

EXAMPLE 13

100 grams of borax was introduced into a graphite crucible having an inner diameter of 35mm and heated up to 1,000°C for melting the borax in an electric furnace. Then 34 grams of chromium chloride powder ($CrCl_3$) was introduced gradually into the motlen borax and mixed up to prepare a treating molten bath.

Next, Specimens 13–1 to 13–8 having the same shape and made of the same cemented carbide as those of the specimens used in Example 9 were respectively immersed into the treating molten bath and treated under the respective conditions shown in Table 4.

Table 4

| Sample No. | 13-1 | 13-2 | 13-3 | 13-4 | 13-5 | 13-6 | 13-7 | 13-8 |
|---|---|---|---|---|---|---|---|---|
| Current density (A/cm²) | 0.01 | 0.05 | 0.1 | 0.5 | 1.0 | 3.0 | 5.0 | 10.0 |
| Treating time | 15 hr. | 8 hr. | 10 hr. | 10 hr. | 1 hr. | 10 min. | 5 min. | 1 min. |
| Thickness of the formed layer (μ) | 10 | 15 | 15 | 20 | 7 | 6 | 7 | 5 |

By the treatment, Specimens 13–1 to 13–8 were formed with a layer having a rspective thickness shown in Table 4. From the layers formed on Specimens 13–1 to 13–8 were clearly detected chromium carbide ($Cr_7C_3$) by X-ray diffraction method. The chromium carbide layers formed on Specimens 13–5 to 13–8 were identified to contain boron by X-ray micro analyzer.

Specimens treated under the same conditions as those of Specimens 13–2 and 13–5 wer subjected to either the oxidation test or corrosion test described in Example 9. The oxidation weight gain and the dissolved weight loss of the specimens treated under the same condition as that of Specimen 13–2 were respectively measure to be 6.31 mg/cm² and 4.15 mg/cm². The oxiation weight gain and dissolved weight loss of the specimens treated under the same condition as that of Specimen 13–5 were respectively measured to be 5.75 mg/cm² and 3.34 mg/cm².

EXAMPLE 14

500 grams of borax was introduced into a graphite crucible having an inner diameter of 65mm and heated up to 1,000°C for melting the borax in an electric furnace. Then a chromium plate, 10 × 10 × 5mm, was dipped into the molten borax bath. With use of the plate and crucible as an anode and cathode respectively, said plate was anodically dissolved into the molten borax by applying a direct current for 8 hours at a current density of 1 A/cm². Thus, a treating molten bath containing 4.2% of chromium was prepared.

Next, Specimens 14–1 and 14–2 having the same shape and made of the same cemented carbide as those of specimens used in Example 9 were respectively immersed into the treating molten bath and respectively treated for 12 hours with 0.01 A/cm², and for 1 minute with 15 A/cm².

By the treatment, Specimens 14–1 and 14–2 were formed with a layer having a respective thickness of about 15μ and about 6μ. From the formed layers, diffraction lines of $Cr_7C_3$ were clearly detected by X-ray micro analyzer. The layer formed on Specimen 14–2 was identified to contain boron by X-ray diffraction method.

What is claimed is:

1. A method for forming a hard layer containing at least one member selected from the group consisting of chromium carbide and chromium boride on the surface of a cemented carbide article containing at least 0.05% by weight of carbon, which comprises preparing a molten bath containing molten boron oxide and a substance containing chromium, immersing the article into the molten bath contained in a vessel, applying an electric current to the molten bath through said article as a cathode so as to deposit a member selected from the group consisting of (1) chromium and (2) a mixture of chromium and boron, on the surface of the article and form a hard layer containing at least one member selected from the group consisting of chromium carbide and chromium boride on the surface of said article, and removing the resultant article from the molten bath.

2. A method according to claim 1, wherein said molten bath contains 50 to 99% by weight of said boron oxide, the remainer of said molten bath being the chromium-containing substance dissolved in said boron oxide.

3. A method according to claim 2, wherein said chromium-containing substance is an oxide of chromium.

4. A method according to claim 3, wherein said cemented carbide article is treated in said molten bath at a current density of the cathode within a range from 0.01 to 15 $A/cm^2$.

5. A method according to claim 4, wherein said molten bath is maintained at a temperature within the range from 800° to 1100°C.

6. A method according to claim 3, wherein said oxide of chromium is selected fromm the group consisting of $Cr_2O_3$, $(NH_4)_2Cr_2O_7$, $K_2Cr_2O_7$, $K_2CrO_4$, $Na_2Cr_2O_7$ and mixtures thereof.

7. A method according to claim 2, wherein said chromium-containing substance is metallic chromium or a chromium alloy.

8. A method according to claim 7, wherein said chromium-containing substance is in the form of a powder.

9. A method according to claim 7, wherein said chromium-containing substance is in the form of a block, and said block is anodically dissolved in the molten boron oxide.

10. A method according to claim 7, wherein said cemented carbide article is treated in said molten bath at a current density of the cathode within a range from 0.01 to 15 $A/cm_2$.

11. A method according to claim 2, wherein said chromium-containing substance is a halide of chromium.

12. A method according to claim 11, wherein said halide is selected from the group consisting of $CrCl_3$, $CrCl_2$, $CrF_3$, $CrBr_3$, $CrI_3$ and mixtures thereof.

13. A method according to claim 11, wherein said cemented carbide article is treated in said molten bath at a current density of the cathode within a range from 0.01 to 15 $A/cm^2$.

14. A method according to claim 1, wherein said boron oxide is selected from the group consisting of boric acid and a borate.

15. A method according to claim 14, wherein said borate is selected from the group consisting of sodium borate and potassium borate.

16. A method according to claim 1, wherein said molten bath contains 1 to 50% by weight of chromium, the remainder of said molten bath being boron oxide.

17. A method according to claim 1, wherein a mixture of chromium and boron is deposited on the surface of the article and the hard layer formed on the surface of the article contains a mixture of chromium carbide and chromium boride.

* * * * *

UNITED STATES PATENT OFFICE
CERTIFICATE OF CORRECTION

Patent No. 3,959,092 Dated May 25, 1976

Inventor(s) NOBORU KOMATSU, TOHRU ARAI and YOSHIHIKO SUGIMOTO

It is certified that error appears in the above-identified patent and that said Letters Patent are hereby corrected as shown below:

Change section [30] of the heading of the Patent to read as follows:

-- [30] Foreign Application Priority Data

| | | |
|---|---|---|
| Nov. 16, 1972 | Japan | 47-114290 |
| June 23, 1973 | Japan | 48-070440 |
| June 23, 1973 | Japan | 48-070441 |
| June 26, 1973 | Japan | 48-071275--. |

Signed and Sealed this

Nineteenth Day of October 1976

[SEAL]

*Attest:*

RUTH C. MASON
*Attesting Officer*

C. MARSHALL DANN
*Commissioner of Patents and Trademarks*